United States Patent [19]

Lake, Jr.

[11] Patent Number: 4,765,324

[45] Date of Patent: Aug. 23, 1988

[54] SPORTS MOUTHGUARD WITH SHIM

[76] Inventor: John R. Lake, Jr., 3854 Falmouth Rd., Marstons Mills, Mass. 02648

[21] Appl. No.: 860,850

[22] Filed: May 8, 1986

[51] Int. Cl.[4] ..... A61F 5/56

[52] U.S. Cl. ..... 128/136

[58] Field of Search ..... 128/136, 137; 433/6; 119/129

[56] References Cited

U.S. PATENT DOCUMENTS

| | | | |
|---|---|---|---|
| 3,089,487 | 5/1963 | Enicks et al. | 128/136 |
| 3,211,143 | 10/1965 | Grossberg | 128/136 |
| 3,496,936 | 2/1970 | Gores | 128/136 |
| 3,505,995 | 4/1970 | Greenberg | 128/136 |
| 3,518,988 | 7/1970 | Gores | 128/136 |

*Primary Examiner*—Robert A. Hafer
*Assistant Examiner*—Kevin G. Rooney
*Attorney, Agent, or Firm*—John P. McGonagle

[57] ABSTRACT

A new and improved mouthguard adapted to minimize shock to the teeth and head area. The mouthguard is comprised of a member having an approximate U-shape corresponding generally to the shape of the arch of the upper jaw. The member, which is of substantially channel shape in cross section, is fitted over the upper teeth. The member has a bottom wall designed to engage the lower teeth. The construction of the bottom wall is a sandwich or layered configuration comprised of an energy absorbing elastomer enclosed in a tough, durable and less compressible material.

1 Claim, 2 Drawing Sheets

SPORTS MOUTHGUARD WITH SHIM

BACKGROUND OF THE INVENTION

This invention relates to mouthguards and in particular to a new and improved mouthguard adapted to minimize shock to the teeth and head area.

In the many contact sports played throughout the world, the use of mouthguards is nearly universal. Over the years many attempts have been made to develop a mouthguard that would offer suitable protection to the teeth and supporting structures. A number of surveys and studies have been conducted to evaluate the effectiveness of the various types of mouthguards. The results of these studies can be summarized broadly by the statement that any of the mouthguards will reduce oral injuries. A consensus seems to exist that all offer some type and degree of protection, however, the consensus also seems to be that the ideal mouthguard has not yet been developed.

In a recent study of Texas high school football athletes ("An Evaluation of Mouthguard Programs in Texas High School Football," by Richard R. Seals, Jr., DDS, et al, JADA, Vol. 110, p. 904, June 1985) more than 50% of the 534 reported injuries were concussions. The 269 concussions reported by 126 of the schools would tend to indicate a need to reevaluate the protection provided by mouthguards for concussions and other central nervous system injuries.

Most conventional mouthguards consist simply of U-shaped, trough-like members of resilient material, such as rubber or a suitable plastic, shaped to fit over the upper or lower teeth or both. While the typical mouthguard offers some protection for the teeth, such mouthguards provide little, if any, protection against head and neck injuries.

Normally, the head of the condyle of the mandible articulates with a cartilagenous disk or movable cartilogenous pad in the temporomandibular joint. It is this pad which glides between the condylar head of the mandible and the articular surface of the glenoid fossa of the temporal bone. When wearing conventional mouthguards, the athlete is subject to damage resulting from direct transmittal of force through the mandible, the thin layer of cartilage, and into the temporal bone and the cranial cavity. Substantial increases in intracranial pressure and cranial bone deformation have been shown to occur when a football player, for example, receives a blow on the chin or on the faceguard of the protective helmet. This results in a measurable deformation of the skull. Similar damage occurs in other contact sports, such as boxing, hockey, lacrosse, etc. Because of the use of protective helmets with faceguards for intercepting horizontal blows, the principal injuries to football players in the head area results from upward blows to the lower jaw, especially the chin area, and from upward blows to the faceguard which transmits force to the jaw through the chin strap.

In an attempt to solve this problem, U.S. Pat. No. 4,337,765 to E. S. Zimmerman discloses a mouthguard constructed so as to provide an increased separation between the mandible and the glenoid fossa, and to slightly increase this separation in the case of a blow to the chin or face. The Zimmerman mouthguard provides a pivoting action about a fulcrum point in the molar area to cause a slight rocking shock absorption motion. The Zimmerman premise is that in the case of a blow to the chin or face a pivoting action would occur about the lower first molar causing a slightly increased separation between the condyle of the mandible and the temporal bone. This is accomplished, supposedly, by placing a greater thickness of material in the bottom wall of the mouthguard in the region engaging the lower first molar. The difficulty of such a design is in achieving a balanced occlusion. Maintaining an increased separation in the first molar area would preclude teeth anterior and posterior to that point contacting firmly. Although Zimmerman states that the occlusion is balanced from first bicuspid to second molar while following the typical Curve of Spee, if such a state were achieved, it would preclude a static increased thickness in the area of the lower first molar. One either achieves a pivoting thickness or a balanced bite, but not both. In supposing a pivoting thickness was maintained in the Zimmerman mouthguard, we must look closer at what is achieved by such a design under function. Similar to all mouthguards or orthopedic repositioning appliances, the temporomandibular joint is placed in a rest state by simply opening the bite in a range of 3 to 5 millimeters. Such openings advance the head of the condyle anteriorly and inferiorly. This has been a long established premise in the treatment of temporomandibular joint disorders with occusally balanced hard acrylic orthopedic splints. Such a situation allows derangements and imbalances of the muscles and ligaments of the temporomandibular joint area to regain their tone and balance. Bringing about such a balance relieves patients suffering from a wide range of symptoms, often caused by an imbalanced occlusion. Use of the Zimmerman mouthguard by an athlete with a temporomandibular joint disorder may be hazardous. Further separation or opening of the temporomandibular joint and the rocking shock absorption technique upon receiving a blow to the lower jaw may only serve to place additional stresses on already imbalanced and symptomatic muscles and ligaments. This may result in tears and/or rips in the muscles and ligaments.

SUMMARY OF THE INVENTION

The present invention is an improved sports mouthguard whereby the mouthguard comprises a member, having an approximate U-shaped corresponding generally to the shape of the arch of the upper jaw, formed of a resilient material, and having an energy absorbing elastomeric insert made of a material such as disclosed in U.S. Pat. No. 4,346,205 to M. A. F. Hiles. More particularly, the member includes a bottom wall designed to engage the lower teeth, and spaced side walls or flanges extending upwardly therefrom and forming a cavity for receiving the upper teeth. Laterally, the bottom wall comprises an approximately planar surface of sufficient width to extend laterally the full width of the lower teeth and engage both the buccal and the lingual cusps of the lower teeth. The construction of the bottom wall is a sandwich or layered configuration comprised of an energy absorbing elastomer enclosed in a tough, durable and less compressible material.

The overall design of the present invention will advance the head of the condyle of the mandible inferiorly and anteriorly to minimize impingement on the temporomandibular joint. Previous mouthguards have been made entirely of a tough and hard to compress material and would transmit concussive forces through it to the opposing arch and temporomandibular joint. The improvement of the present invention, i.e., the energy absorbing elastomer insert, acts to absorb such concussive forces. This is in addition to the separation between the condyle of the mandible and the temporal bone and will act to minimize damage caused by forces transmitted to the oral skeleton.

The present invention is designed to achieve and maintain a safe orthopedic repositioning of the lower jaw. In doing so, a balanced and healthy arrangement of the temporomandibular joint is assured. By relying on a shock absorbing elastomer to maintain this relationship, muscles and ligaments will not be subjected to radical or fast alterations which could result in tears or dislocations. Furthermore, the present invention's maintenance of a balanced bite, similar to that achieved by a mandibular orthopedic repositioning appliance (MORA), may increase an athlete's overall strength and stamina. The MORA appliance is a hard acrylic appliance worn on the mandibular arch, and creates a balanced plane of occlusion from first bicuspid to second molar. In doing so a similar anterior and inferior spacing of the head of the mandibular condyle is achieved on the temporomandibular joint. Many scientific articles have substantiated an increased strength in weight lifters and stamina in long distance runners when such an appliance is used. The pivoting thickness of Zimmerman in the first molar area does not comply with such an occlusal balance, while the balanced and stable design of the present invention lends itself to delivering benefits similar to the MORA.

Various advantages and features of novelty which characterize the invention are pointed out with particularity in the claims annexed hereto and forming a part hereof. However, for a better understanding of the invention, its advantages and objects obtained by its use, reference should be had to the drawings, which form a further part hereof, and to the accompanying descriptive matter in which there is illustrated and described a preferred embodiment of the invention.

DESCRIPTION OF THE PREFERRED EMBODIMENT

Figure 1:
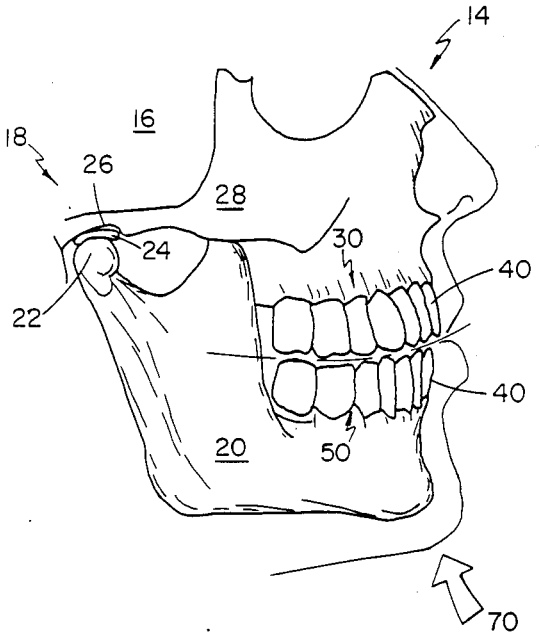
FIG. 1 is a profile view of a human head illustrating the general location of the teeth and of the temporomandibular joint.
Figure 2:
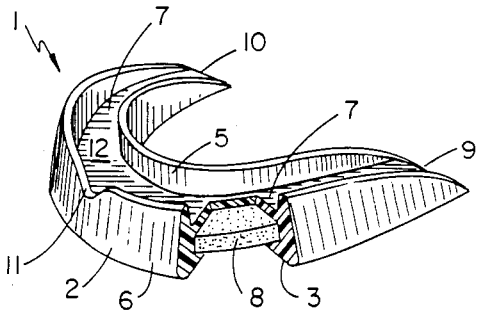
FIG. 2 is a perspective view of the mouthguard of this invention with a portion cut away to show the interior of the mouthguard.
Figure 3:
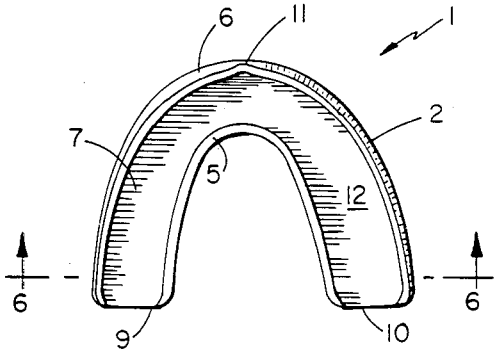
FIG. 3 is a top plan view of the mouthguard shown in FIG. 2.
Figure 4:
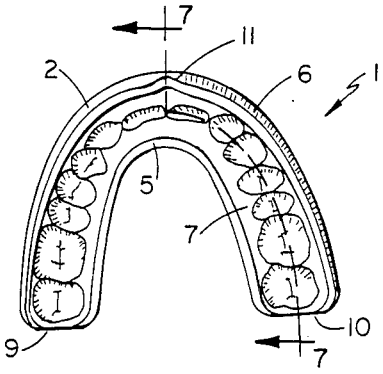
FIG. 4 is a top plan view of the mouthguard shown in FIG. 3 after an impression of the upper teeth has been made.
Figure 5:
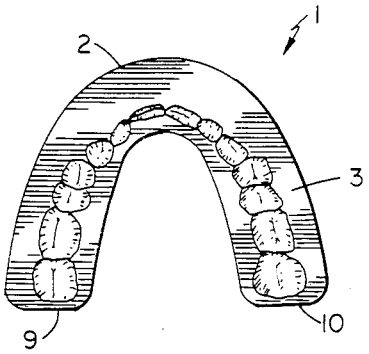
FIG. 5 is a bottom plan view of the mouthguard shown in FIG. 4 after an impression of the lower teeth has been made.
Figure 7:
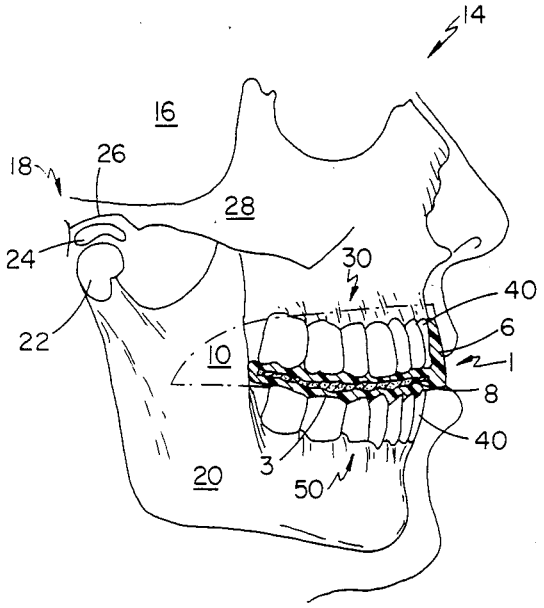
FIG. 7 is a sectional view taken substantially along the curve 7—7 of FIG. 4, showing the mouthguard of this invention in position on the teeth of FIG. 1.
Figure 6:
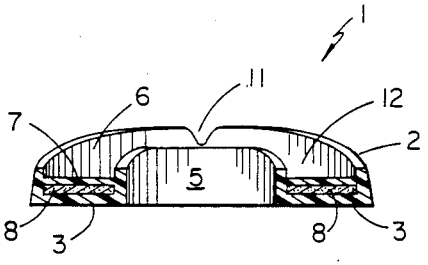
FIG. 6 is a transverse section taken substantially along the plane of section 6—6 of FIG. 3, showing details of the mouthguard construction.

Referring to the drawings in detail, wherein like numerals indicate like elements, reference numeral 1 refers generally to the mouthguards comprising the present invention. FIG. 1 illustrates a portion of the human head 14 with sections broken away to illustrate the upper 30 and lower 50 teeth, and the temporomandibular joint area 18. This area 18 consists basically of the mandible 20, mandible condyle 22, articular disk 24, temporal bone 28, and the glenoid fossa 26 of the temporal bone 28. The cranial cavity is indicated generally by reference numeral 16. The temporomandibular joint 18 is fragile, and the glenoid fossa 26 of the temporal bone 28 is the thinnest bone in the skull. Forces 70 to the lower jaw area, i.e., the mandible 20, tend to pass through the articular portion of the mandible, i.e., the condyle 22, through the articular disk 24 which is only a thin layer of cartilege, and into the temporal bone 28 and the cranial cavity 16. When the force 70 is strong enough, concussions occur.

Referring now more particularly to FIGS. 2, 3, 4, 5 and 6, the mouthguard 1 consists essentially of a generally U-shaped member or casing 2 which is of substantially channel shape in cross-section. The casing 2 is defined by a bottom wall 3 designed to engage the lower teeth 50, and front 6 and rear 5 side walls extending upward therefrom forming a channel 12 for receiving the upper teeth 30. Between the channel floor 7 and the bottom wall 3 is an insert 8 formed of an energy absorbing elastomer. The channel floor 7 and bottom wall 3 are sealed at the casing 2 ends 9 and 10, thereby completely enclosing the insert 8. The casing 2 is made of a tough and durable material, less compressible than the insert 8. Such a tough outer case would be resistant to wear and abrasion, and would reduce the potential of bite-through prevalent in many mouthguard types.

The rear 5 and front 6 side walls are intended to conform generally to the lingual and buccal areas, respectively, of the upper teeth and gums, and each of the walls 5 and 6 end in rounded edges at 9 and 10, approximating the gingival tissues. The front side wall 6 is notched downwardly at its midpoint 11 to provide space for the superior labial frenum. Laterally, the bottom wall 3 comprises an approximately planar surface of sufficient width to extend laterally the full width of the lower teeth and engage both the buccal and lingual cusps of the lower teeth 50. The bottom wall 3 is formed to correspond anteroposterily with the normal dental Curve of Spee found between the upper and lower dental arches.

In this embodiment of the invention 1, the exterior material of the casing 2 is molded from a composition of liquid impermeable ethylene vinyl acctate copolymer having a melting point whereby when heated to a temperature in excess of normal body temperature can be molded to receive an impression of the wearer's teeth, and when cooled to the normal human body temperature, is resilient and shape retaining. See FIGS. 4 and 5. Through the heating and cooling processes, the energy absorbing elastomer insert 8 is temperature stable. The insert 8 is also chemically stable up to the temperature needed to plasticize the outer casing 2, typically between 90° C. and 120° C. The casing 2 may also be made of other tough, flexible polymeric matrices, such as rubber modified polystyrene, a polyolefin, a flexible polyester, an epoxy resin or a polyvinyl chloride. Varying the thickness of the elastomer insert 8 in different mouthguards will allow adaptation to differing size and shock absorption demands from various athletic activities.

Figure 9:
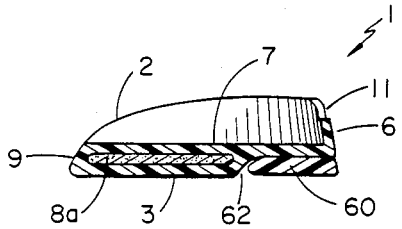
FIG. 9 is a sectional view taken substantially along the curve 9—9 of FIG. 8.
Figure 8:
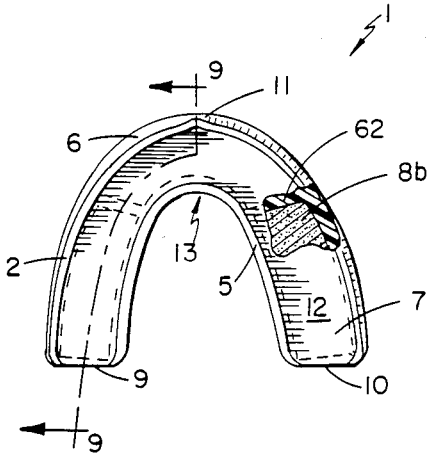
FIG. 8 is a top plan view of another embodiment of the invention with a portion cut away to show the interior of the mouthguard.
Figure 10:
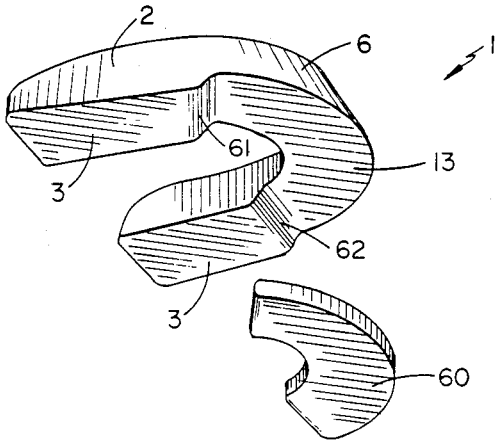
FIG. 10 is a partially exploded perspective view of the embodiment shown in FIGS. 8 and 9.

FIGS. 8, 9 and 10 show another embodiment of the invention, whereby the anterior portion 13 of the mouthguard 1 is recessed upwardly or offset superiorly to provide a space between said anterior portion 13 and the incisors 40 of the lower teeth 50. This minimizes stress to the incisor teeth 40, which being single-rooted, are more prone to fracture; allows freer cushioning action; and provides easier breathing and speaking while the mouthguard is being worn. This embodiment has a removable shim 60 filling in the upward recess of the bottom wall 3 in the anterior portion 13 of the mouthguard 1. The shim 60 engages the lower teeth 50 incisors 40 to facilitate proper fitting of the mouthguard 1 during the heating and molding process. After an impression of the wearer's teeth 30 and 50 is obtained, the shim 60 is then removed and discarded. The one piece insert 8 of the previous embodiment is replaced with two molar insert pads 8*a* and 8*b*, extending from the left and right bicuspids posteriorly over the left and right molars. The molar insert pads 8*a* and 8*b* are made of the same material as the previously described insert 8 and are fully enclosed between the channel floor 7 and bottom wall 3. As previously described, the ends 9 and 10 of the mouthguard 1 are sealed. In this embodiment the bottom wall 3 is curved upward at 61 and 62 where the shim 60 is first met moving from the ends 9 and 10 toward the anterior portion 13 of the mouthguard 1. The upward curves at 61 and 62 effectively seal off the insert pads 8*a* and 8*b*.

It is understood that the above-described embodiment is merely illustrative of the application. Other embodiments may be readily devised by those skilled in the art which will embody the principles of the invention and fall within the spirit and scope thereof.

I claim:

1. An improved sports mouthguard in combination with a shim, used for molding the mouthpiece, comprising:

a member with a channel shaped cross-section, formed from a deformable material, said deformable material being adapted to be impressed by the upper and lower teeth and to conform thereto, and said member having two ends and an approximate U-shape corresponding to the shape of the arch of the upper jaw, and being defined by a bottom wall designed to engage the lower teeth, and front and rear side walls extending upward therefrom forming a channel with a floor for receiving the upper teeth, wherein the channel floor and bottom wall are sealed at the member ends, and the bottom wall laterally comprises a surface of sufficient width to extend laterally the full width of the lower teeth and engage the buccal and lingual cusps of the lower teeth, and wherein the anterior portion of said bottom wall is recessed upwardly to provide a space between said anterior portion and the lower teeth incisors;

two, molar, energy absorbing, elastomeric, insert pads, each encased within the member and extending one each from the left and right bicuspids posteriorly the length of the molar region, said insert pads being positioned between the channel floor and the bottom wall of the member, wherein said insert pads are more compressible than said member; and a removable shim filling in the upward recess of the bottom wall for engaging the lower teeth incisors to facillitate proper positioning of the mouthguard during fitting.

* * * * *